US005823057A

United States Patent [19]

Hsien

[11] Patent Number: 5,823,057

[45] Date of Patent: Oct. 20, 1998

[54] JOY STICK STRUCTURE

[76] Inventor: Ming-kun Hsien, No. 53, Chungcheng Rd., Hsitzu Chen, Taipei Hsien, Taiwan

[21] Appl. No.: 704,437

[22] Filed: Aug. 16, 1996

[51] Int. Cl.[6] ..... G05G 9/047

[52] U.S. Cl. ..... 74/471 X; 200/6 A; 273/148 B; 345/161

[58] Field of Search ..... 74/471; 200/6 A; 273/148 B; 345/161

[56] References Cited

U.S. PATENT DOCUMENTS

| | | | |
|---|---|---|---|
| 2,100,642 | 5/1937 | Geyer | 74/473 |
| 3,156,134 | 11/1964 | Forrester | 74/471 X |
| 4,124,787 | 11/1978 | Aamoth et al. | 74/471 XY X |
| 4,459,440 | 7/1984 | Wiczer | 200/6 A |
| 4,533,899 | 8/1985 | Isaksson | 338/128 |
| 5,140,313 | 8/1992 | Wen | 200/6 A |
| 5,468,924 | 11/1995 | Naitou et al. | 74/471 XY X |

*Primary Examiner*—Charles A. Marmor
*Assistant Examiner*—Ankur Parekh
*Attorney, Agent, or Firm*—Abelman, Frayne & Schwab

[57] ABSTRACT

A joy stick structure for video game comprises a pressing plate having a central socket integrally provided thereunder, a body having a central through hole, a plurality of first spaces and a second space, a stick having a first end with a sphere thereof and a second end firmly received within the central socket of the pressing plate through the central through hole of the body and a plurality of transmission mechanisms securely received within the first spaces of the body. A positioning boss is formed integrally on the sphere and received within the second space of the body preventing unrequired movement of the stick. The sphere of the stick provides a smooth sliding effect.

2 Claims, 3 Drawing Sheets

JOY STICK STRUCTURE

FIELD OF THE INVENTION

The present invention generally relates to a joy stick structure, and more particularly to a video game joy stick having a sphere at one distal end thereof, for providing smooth rotation and precise controlling ability.

BACKGROUND OF THE INVENTION

When trying to control the moving direction of an object in a conventional video game having a cross controller or a plane controller with four areas individually controlling up and down and right and left of the object, a user will have to continuously move his/her fingers back and forth or up and down in order to have a precise control of the object. A video game having a cross controller or a plane with four areas individually controlling up and down and right and left of the object can only provide two dimensional movement to the object, thus it is not able to have the object moving in curved direction, which limits the the fun of the video game dramatically. Due to the drawbacks mentioned above, there is another video game controller using a special structure to move the object in the game in a curved direction. This kind of controller permits simultaneous pressing down of switches controlling the object whereby the object can move up and right respectively to give it an ability to move in a curved direction, which indeed increases entertainment to the video game. Yet, both switches pressed simultaneously by a user are not pressed directly and respectively but only part of them, which very often causes malfunction to the controller.

There has been a long and unfulfilled need of a joy stick for video games, which tends to mitigate and/or obviate the aforementioned problems.

SUMMARY OF THE INVENTION

The main objective of the invention is to provide a joy stick having a sphere at one distal end thereof for providing smooth and precise controlling of an object in a video game.

Another objective of the invention is to provide a retaining device to the joy stick to keep it in a firm position while being turned.

Still another objective of the invention is to provide a plurality of resilient members disposed around the sphere, in order to provide a recoil force to the joy stick.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
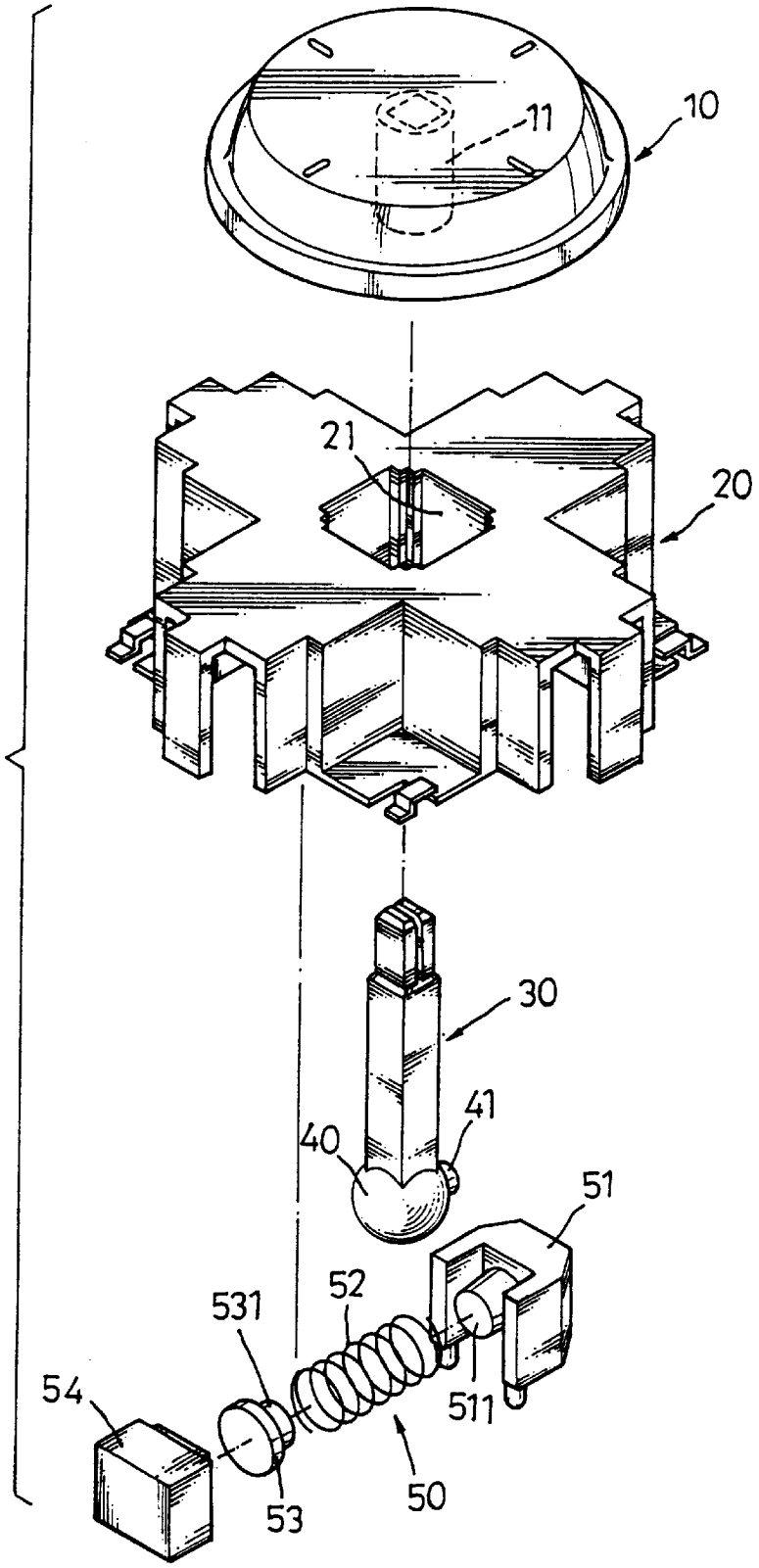
FIG. 1 is an exploded view of one preferred embodiment constructed in accordance with the present invention.

Referring to FIG. 1, one preferred embodiment of the invention is shown. A joy stick constructed in accordance with the present invention comprises a pressing plate 10 having a central socket 11 integrally formed thereunder, a body 20 having a central through hole 21, a stick 30 having a sphere 40 at a first end (not labeled) thereof and a plurality of transmission mechanisms 50. A second end (not labeled) of the stick 30 is fixedly mated with the socket 11 of the pressing plate 10 after the stick 30 is inserted through the central through hole 21 of the body 20, thereby allowing the pressing plate 10 to control the movement of the stick 30 directly. A plurality of first spaces 22 are provided within the body 20 to receive the plurality of transmission mechanisms therein.

Figure 2:
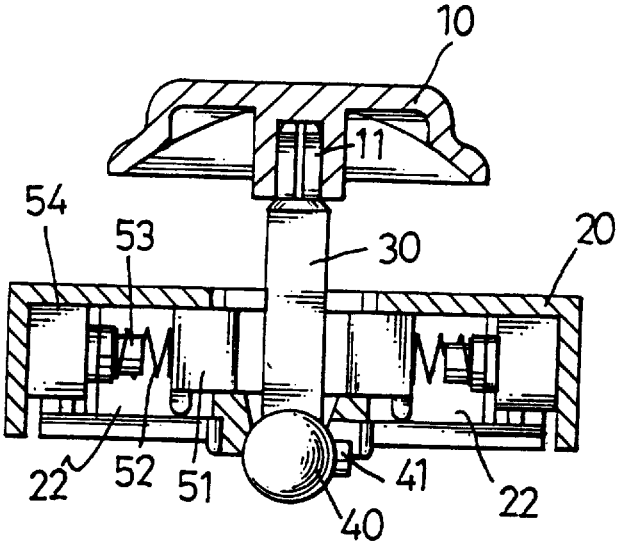
FIG. 2 is a plane view of the invention in a partial sectional view.

Referring to FIGS. 1 and 2, the transmission mechanism 50 is composed of a receiver 51 having a central boss 511 integrally formed thereon, a resilient member 52 seated on the boss 511 of the receiver 51, a presser 53 having a protrusion 531 provided on a first face (not numbered) and configured to receive the resilient member 52 and a activation switch 54 disposed adjacent to a second face (not numbered) of the presser 53. Therefore, after the stick 30 is inserted into the socket 11 of the pressing plate 10 via the central through hole 21 of the body 20 and the plurality of transmission mechanisms 50 each are received within individual first space of the body 20, the joy stick thus constructed in accordance with the present invention is ready to be used.

FIG. 1 and FIG. 2 also clearly show that a positioning boss 41 is formed on the sphere 40 and is securely received within a second space (not shown), of the body 20 for positioning the stick 30 within the body 20.

Figure 3:
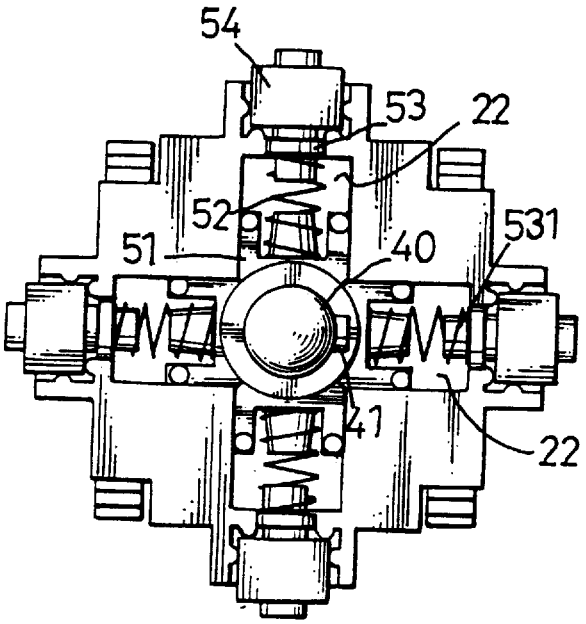
FIG. 3 is a bottom view of the invention corresponding to FIG. 2.

Referring to FIG. 3, it is noted that when the stick 30 with a sphere 40 securely connected thereto is mated with the socket 11 of the pressing plate 10 through the central through hole 21 of the body 20 and the positioning boss 41 is received within the second space of the body 20, the receiver 51 having the resilient member 52 with its first side seated on the central boss 511 thereof and second side mated with the protrusion 531 of the presser 53 is adjacent next to the stick 30 and is not in contact with the stick 30, so that the stick 30 will have an allowance to move back and forth. Also, because the first face of the presser 53 is mated with the resilient member 52 and the second face of the presser 53 is adjacent and in contact with the activation switch 54, a force from the receiver 51 will be directly transmitted to the activation switch 54 and therefore activate the switch 54 through the resilient member 52.

Figure 4:
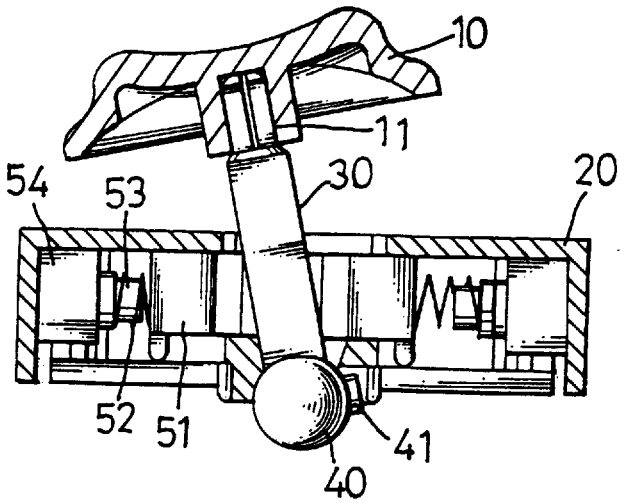
FIG. 4 is a schematic view showing the movement of a joy stick constructed in accordance with the present invention.

Referring to FIG. 4, when the pressing plate 10 is pushed to the left by a user, the sphere 40 will provide a smooth sliding action on a housing (not shown) and this consequently results in the activation switch 54 to be activated by the presser 51 through the resilient member 52.

Figure 5:
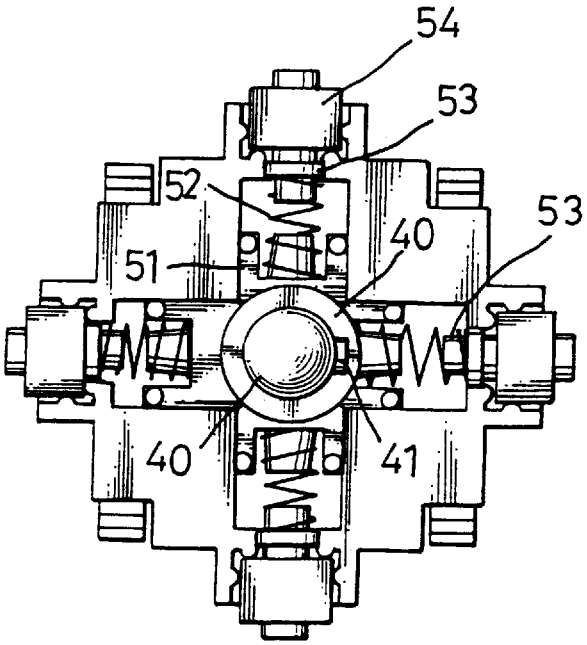
FIG. 5 is a bottom view of the invention corresponding to FIG. 4.

From the previous description, it is clearly shown that the left side transmission mechanism 50 is pushed by the stick 30 and therefore the receiver 51 will directly transmit the force to the activation switch 54 through the resilient member 52 and the presser 53 and because the transmission mechanism 50 on the right side of the stick 30 is not pushed by the stick 30, it remains stationary as shown in FIG. 5.

As the relationship of the upward movement or the downward movement of the stick 30 and the transmission mechanism 50 is the same as the relationship discussed in FIG. 4, therefore there is no need to describe all the related movements again.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A joy stick structure comprising:

a pressing plate having a central socket integrally provided thereunder;

a body having a central through hole and a plurality of first spaces defined therein;

a stick having a sphere at a first end thereof and a second end securely inserted into said central socket of said pressing plate through said central through hole of said body;

a plurality of transmission mechanisms each firmly received within a respective one of said plurality of first spaces of said body and spaced apart from said stick a predetermined distance and, having:

a receiver having a central boss;

a resilient member having a first end securely seated on said central boss of said receiver and a second end;

a presser having a central protrusion formed on a first face and configured to mate with said second end of said resilient member and a second face; and an activation switch in contact with to said second face of said presser.

2. The joy stick as claimed in claim 1, wherein said resilient member is a coil spring.

* * * * *